US009620141B2

(12) United States Patent
Benway et al.

(10) Patent No.: US 9,620,141 B2
(45) Date of Patent: Apr. 11, 2017

(54) SPEECH INTELLIGIBILITY MEASUREMENT AND OPEN SPACE NOISE MASKING

(71) Applicant: Plantronics, Inc., Santa Cruz, CA (US)

(72) Inventors: Evan Harris Benway, Santa Cruz, CA (US); Erik Perotti, Santa Cruz, CA (US); Kwangsee Allen Woo, Scotts Valley, CA (US)

(73) Assignee: Plantronics, Inc., Santa Cruz, CA (US)

( * ) Notice: Subject to any disclaimer, the term of this patent is extended or adjusted under 35 U.S.C. 154(b) by 112 days.

(21) Appl. No.: 14/188,200

(22) Filed: Feb. 24, 2014

(65) Prior Publication Data

US 2015/0243297 A1 Aug. 27, 2015

(51) Int. Cl.
*G10L 21/0208* (2013.01)
*H04K 3/00* (2006.01)

(52) U.S. Cl.
CPC ..... *G10L 21/0208* (2013.01); *H04K 3/43* (2013.01); *H04K 3/825* (2013.01); *H04K 3/94* (2013.01); *H04K 2203/12* (2013.01); *H04K 2203/36* (2013.01)

(58) Field of Classification Search
CPC ..... G10L 21/0208
See application file for complete search history.

(56) References Cited

U.S. PATENT DOCUMENTS 8,116,461 B2 2/2012 L'Esperance et al.
2003/0103632 A1 6/2003 Goubran et al.
2003/0182104 A1* 9/2003 Muesch ..... 704/200.1
2004/0146168 A1 7/2004 Goubran et al.
2006/0247919 A1 11/2006 Specht et al.
2010/0086137 A1 4/2010 Nicolino, Jr. et al.
2010/0086138 A1 4/2010 Nicolino, Jr. et al.
2010/0086139 A1 4/2010 Nicolino, Jr. et al.
2010/0086141 A1 4/2010 Nicolino, Jr. et al.
2012/0316869 A1 12/2012 Xiang et al.
2015/0181332 A1* 6/2015 Benway ..... H04R 3/002 381/73.1
2015/0371654 A1* 12/2015 Johnston ..... H04M 9/082 381/66

OTHER PUBLICATIONS

Unknown, "Noise Masking—Sleeping and Snoring Relief," found at URL <http://www.earplugstore.com/noise-masking.html> on Apr. 7, 2014.

(Continued)

*Primary Examiner* — Qian Yang
(74) *Attorney, Agent, or Firm* — Chuang Intellectual Property Law

(57) ABSTRACT

Methods and apparatuses for addressing open space noise are disclosed. In one example, a method for masking open space noise includes outputting a test signal from a speaker, the test signal operable to measure a speech transmission quality of a transmission channel. The method includes receiving the test signal at a microphone, outputting a detected test signal, and processing the detected test signal to determine the speech transmission quality of the transmission channel. The method further includes adjusting an output level of a noise masking signal from the speaker responsive to the speech transmission quality.

24 Claims, 9 Drawing Sheets

(56) References Cited

OTHER PUBLICATIONS

Gang et al., "Using Real-Time Adaptive Noise Masking to Mitigate Ambient Interferences," IEEE International Conference on Consumer Electronics (ICCE), pp. 409-410, 2011.
Haapakangas et al., "Effects of Five Speech Masking Sounds on Performance and Acoustic Satisfaction. Implications for Open-Plan Offices," Acta Acustica United with Acustica, 97:641-655, 2011.
Unknown, "White Noise CDs—White Noise Machines & Sound Masking," found at URL <http://www.earplugstore.com/whitenoisecds1.html> on May 12, 2014.
Unknown, "Play Instructions for Maximum Effectiveness of Pure White Noise®," found at URL <https://www.purewhitenoise.com/t-instructions.aspx> on Apr. 7, 2014.
Tart, "An Inexpensive Masking Noise Generator: Monaural or Stereo," Psychophysiology, 2:170-172 (1965).
Unknown, "Sound+Sleep," found at URL <https://soundofsleep.com/> on Jan. 31, 2014.
Unknown, "ASTI Adaptive Sound Sleep Therapy System™ Owner's Manual," Adaptive Sound Technologies, Inc., pp. 1-12, 2011, found at URL <http://soundofsleep.com/wp-content/uploads/2011/08/SoundSleep_Manual.pdf>.
Unknown, "Soft dB Active Volume Control," accessed at URL <http://www.softdb.com/sound-masking-information-active-control.php> on Feb. 13, 2014.
Unknown, "HermanMlller Resolve System," accessed at URL <http://www.hermanmiller.com/content/dam/hermanmiller/documents/product_literature/brochures/Resolve_System_brochure.pdf> on Feb. 13, 2014.
International Search Report and Written Opinion mailed May 8, 2015 for international application No. PCT/US2015/014579.

* cited by examiner

SPEECH INTELLIGIBILITY MEASUREMENT AND OPEN SPACE NOISE MASKING

BACKGROUND OF THE INVENTION

Noise within an open space is problematic for people working within the open space. Open space noise is typically described by workers as unpleasant and uncomfortable. Speech noise, printer noise, telephone ringer noise, and other distracting sounds increase discomfort. This discomfort can be measured using subjective questionnaires as well as objective measures, such as cortisol levels.

For example, many office buildings utilize a large open office area in which many employees work in cubicles with low cubicle walls or at workstations without any acoustical barriers. Open space noise, and in particular speech noise, is the top complaint of office workers about their offices. One reason for this is that speech enters readily into the brain's working memory and is therefore highly distracting. Even speech at very low levels can be highly distracting when ambient noise levels are low (as in the case of someone having a conversation in a library). Productivity losses due to speech noise have been shown in peer-reviewed laboratory studies to be as high as 41%. Office acoustic design has gotten very good at reducing ambient noise, but the quiet environments that have been created can cause speech noise to contrast strongly with the quiet. Even quiet offices, therefore, can create a level of speech intelligibility that is highly distracting.

Another major issue with open offices relates to speech privacy. Workers in open offices often feel that their telephone calls or in-person conversations can be overheard. Speech privacy correlates directly to intelligibility. Lack of speech privacy creates measurable increases in stress and dissatisfaction among workers.

In the prior art, noise-absorbing ceiling tiles, carpeting, screens, and furniture have been used to decrease office noise levels. Reducing the noise levels does not, however, directly solve the problems associated with the intelligibility of speech. Speech intelligibility can be unaffected, or even increased, by these noise reduction measures. As office densification accelerates, problems caused by open space noise become accentuated.

As a result, improved methods and apparatuses for addressing open space noise are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
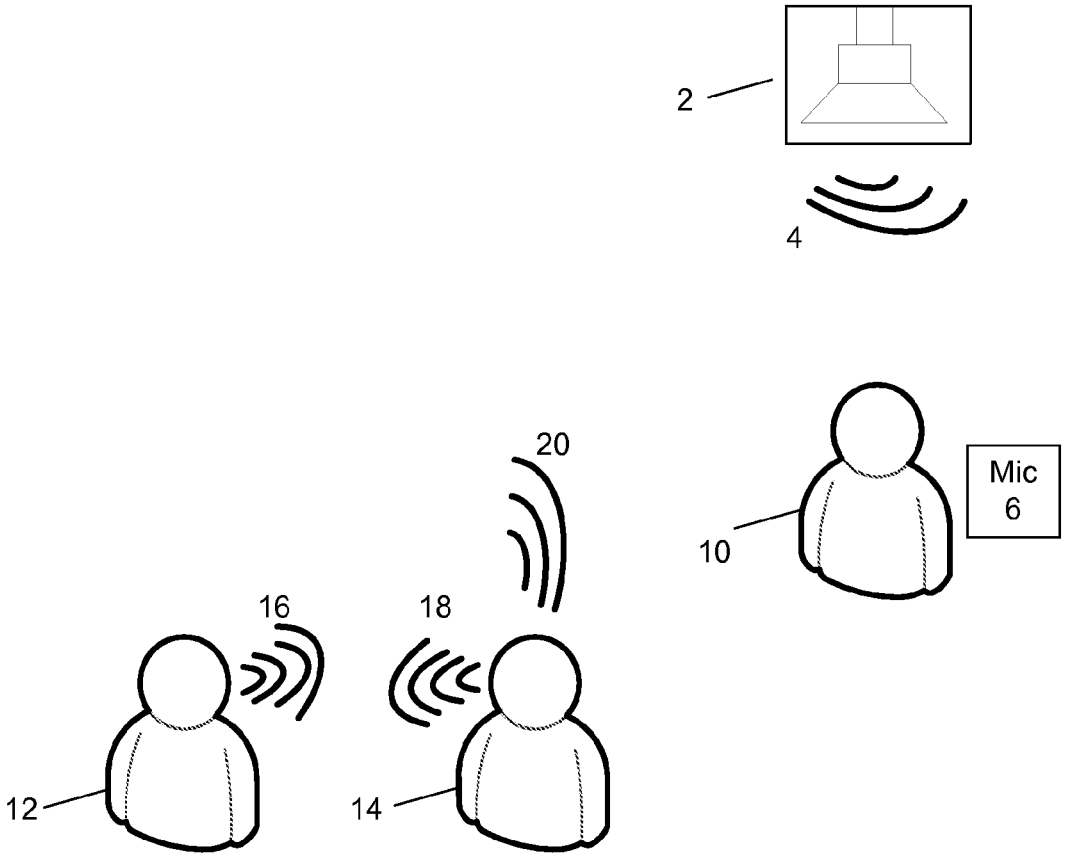
FIG. 1 illustrates a system and method for measuring speech transmission quality in an open space in one example.

Methods and apparatuses for speech intelligibility measurement and masking open space noise are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various examples of the invention, although different, are not necessarily mutually exclusive. Thus, a particular feature, characteristic, or structure described in one example embodiment may be included within other embodiments.

"Sound masking" is the introduction of constant background noise in a space in order to reduce speech intelligibility, increase speech privacy, and increase acoustical comfort. For example, a pink noise, filtered pink noise, brown noise, or other similar noise (herein referred to simply as "pink noise") may be injected into the open office. Pink noise is effective in reducing speech intelligibility, increasing speech privacy, and increasing acoustical comfort.

Sound masking systems may be: (1) in-plenum and (2) direct field. In-plenum systems involve speakers installed above the ceiling tiles and below the ceiling deck. The speakers are generally oriented upwards, so that the masking sound reflects off of the ceiling deck, becoming diffuse. This makes it more difficult for workers to identify the source of the masking sound and thereby makes the sound less noticeable. "Direct field" systems are so named because the masking sound travels directly from the speakers to a listener without interacting with any reflecting or transmitting feature.

The inventors have recognized one problem in designing an optimal sound masking system is setting the proper masking levels and spectra. In the prior art, sound masking levels and spectra are set during installation. The levels and spectra are set equally on all speakers. The problem with this is that office noise levels fluctuate over time and by location, and different masking levels and spectra may be required for different areas. An acoustical consultant installing a sound masking system outside of normal business hours is unlikely to properly address this problem and the masking levels and spectra may therefore be sub-optimal.

One existing solution is a sound masking system that detects room noise levels using microphones installed in the ceiling tiles and adjusts masking levels accordingly. When an increase in background noise levels is detected, the masking level is increased. This solution is inadequate because microphones at ceiling level detect a proportionally high level of plenum-based masking noise and a proportionally low level of head-level speech noise, causing calculated masking levels to be sub-optimal.

Additionally, the inventors have recognized background noise levels alone are not sufficient for determining the optimal level of a masking system. The inventors have recognized that ultimately, it is the intelligibility of speech rather than its level that determines its distractive power. For example, a better metric than volume level is an intelligibility index which measures the intelligibility of human speech.

In one example embodiment of the invention, a sound masking and speech intelligibility measurement system is presented that can be incorporated into or attached to office furniture, including desks, cubicle walls, shelves, light fixtures, etc. In one example, the proposed masking system uses direct field speakers attached to office furniture. The system can also be used in conjunction with other masking systems, including in-plenum speakers or speakers installed in ceiling tiles, or on walls, pillars, etc.

In one example, an intelligibility measurement system (IMS) is advantageously utilized. Measurement of intelligibility is performed using a signal source and a signal analyzer. The signal source produces a modulated, speech-like multi-tone signal, which has the frequency signature of human speech. The signal analyzer is located at some distance from the signal source with a microphone. The signal analyzer measures the modulated, speech-like multi-tone signal and produces an intelligibility index within approximately 20 seconds. The intelligibility index is given on a scale of 0.0-1.0, with 1.0 indicating speech that is perfectly intelligible and 0.0 indicating speech that is perfectly unintelligible.

In one example embodiment, the multi-tone signal is produced by sound masking speakers located in cubicles or office furniture. This is particularly advantageous as it allows the measurements of speech intelligibility to indicate the intelligibility of speech coming from the head level, as office speech is generated in cubicles or work stations and at head level. Thus, one example of the system advantageously generates a multi-tone signal at head level and in cubicles or workstations.

In one example, the multi-tone signal is advantageously blended into the masking sound so that listeners are not disturbed by loud, annoying, clearly-intelligible intelligibility index signals. The advantage of this is that the system can make intelligibility measurements throughout the day, in order to provide information on speech intelligibility changes over time. In one example, the methods and systems described advantageously allow for accurate intelligibility measurements in an automated fashion.

In one example, the signal analyzer is advantageously located at head level in workstations or cubicles. In this manner, the intelligibility measurements more accurately reflect the intelligibility of office speech heard by the listener because the measurement is made at close proximity to persons in the open space.

In one example, locating both the signal source and signal analyzer at head level and within workstations or cubicles advantageously allows for more accurate measuring of the intelligibility of human speech from neighboring workstations, distant workstations, and all locations in between.

In one example, the masking levels are advantageously dynamically adjusted in response to intelligibility measurements. Intelligibility target levels are established and programmed into the masking system, such that the masking sound level and/or spectrum are adjusted in order to obtain those target levels. Masking levels are adjusted on a speaker-by-speaker basis in order to address location-specific intelligibility issues.

In one example, a headset is advantageously utilized as the multi-tone signal analyzer. In this embodiment, a microphone in the headset passes frequency response readings and level readings to software located on a host device or server. Using a headset as the signal analyzer provides highly useful intelligibility readings, as these readings accurately reflect speech intelligibility at the precise location of the headset user's ears. In a further example, a wearable device such as a bracelet may be used in place of a headset.

In one example, a method includes outputting a test signal from a speaker, the test signal operable to measure a speech transmission quality of a transmission channel. The method includes receiving the test signal at a microphone, outputting a detected test signal, and processing the detected test signal to determine the speech transmission quality of the transmission channel. The method further includes adjusting an output level of a noise masking signal from the speaker responsive to the speech transmission quality. In a further example, the output source and/or the output spectrum of the noise masking signal is also adjusted responsive to the speech transmission quality.

In one example, a method includes outputting a noise masking signal from a speaker and outputting a test signal from the speaker, the test signal output together with the noise masking signal and operable to measure a speech transmission quality of a transmission channel. The method includes detecting the noise masking signal and the test signal at a microphone, and processing the test signal to determine the speech transmission quality of the transmission channel. The method further includes adjusting an output level of the noise masking signal responsive to the speech transmission quality.

In one example, a system includes a first workstation having a first speaker disposed at a first workstation furniture, and a first microphone disposed in a first workstation area. The system includes a second workstation having a second speaker disposed at a second workstation furniture and a second microphone disposed in a second workstation area. The system further includes a computing device having a processor, and a memory storing an application program including instructions executable by the processor to perform operations. The operations include outputting a test signal from the first speaker or the second speaker, the test signal operable to measure a speech transmission quality. The operations further include detecting the test signal at the first microphone and adjusting an output level of a first noise masking signal from the first speaker responsive to the detected test signal.

In one example, a system includes a first workstation having a first speaker disposed at a first workstation furniture and a first microphone disposed in a first workstation area. The system includes a second workstation having a second speaker disposed at a second workstation furniture and a second microphone disposed in a second workstation area. The system includes a computing device including a processor and a memory storing an application program comprising instructions executable by the processor to perform operations. The operations includes outputting a first test signal from the first speaker and/or outputting a second test signal from the second speaker, the first test signal and the second test signal operable to measure a speech transmission quality. The operations include detecting the first test signal at the first microphone and adjusting an output level of a first noise masking signal from the first speaker responsive to the detected first test signal. The operations further include detecting the second test signal at the second microphone and adjusting an output level of a second noise masking signal from the second speaker responsive to the detected second test signal. In a further example, the output source and/or the output spectrum of the noise masking signals are also adjusted.

FIG. 1 illustrates a system and method for measuring speech transmission quality (i.e., speech intelligibility) in an open space in one example. In one example, the system includes a speaker 2 arranged to output a speaker sound in an open space such as an office building room, the speaker sound including sound 4 corresponding to a test signal. In one example, the sound 4 is a test signal operable to measure a speech transmission quality of the open space air (i.e., the transmission channel). In one example, the sound 4 corresponding to a test signal is a modulated multi-tone signal having a frequency signature similar to human speech.

The system further includes a microphone 6 disposed in the open space. In one example, the microphone 6 is arranged to be in close proximity to a person 10. The sound 4 corresponding to the test signal is received at the microphone 6, which outputs a detected test signal. The detected test signal is processed to determine the speech transmission quality of the open space air in the vicinity of person 10. In one example, the speech transmission quality measured is an intelligibility index measuring speech intelligibility. Speech intelligibility refers to a measure of effectiveness of understanding or recognizing speech. Unlike contexts such as telephony, speech intelligibility of open space speech is undesirable.

Figure 8:
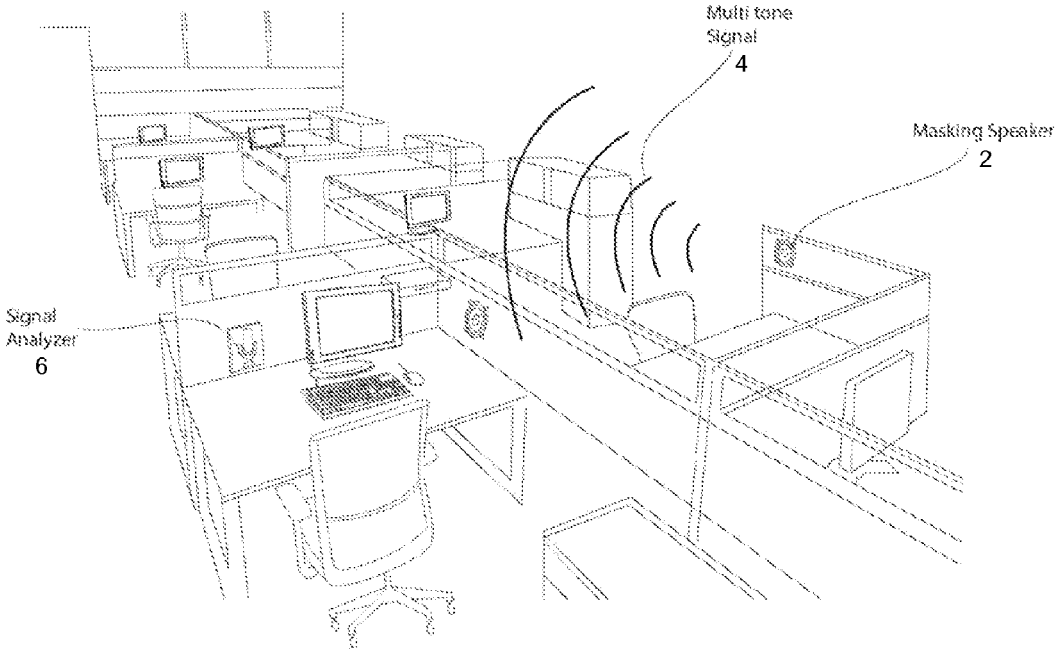
FIG. 8 illustrates placement of the speaker and microphone shown in FIG. 1 in one example.
Figure 9:
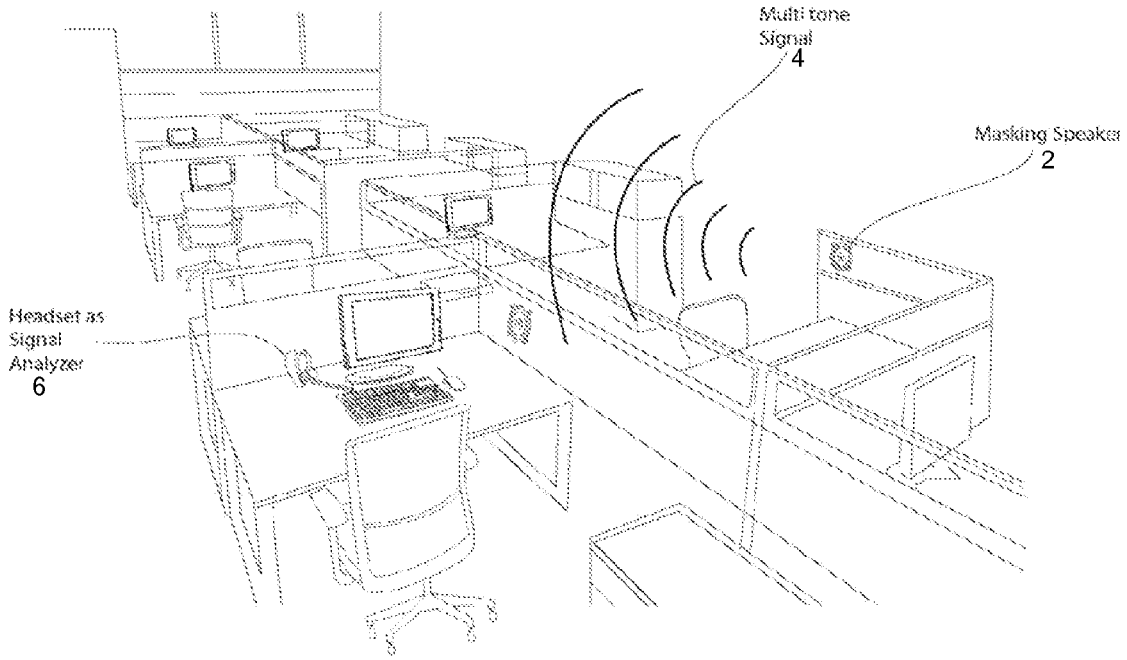
FIG. 9 illustrates placement of the speaker and microphone shown in FIG. 1 in one example.

In one example, the speaker 2 is one of a plurality of loudspeakers which are disposed in furniture in the open space and arranged to direct the speaker sound in a direction towards persons in the open space. FIG. 8 illustrates placement of the speaker 2 shown in FIG. 1 in one example, where each speaker 2 is disposed in a cubicle furniture such as a cubicle wall. FIG. 8 illustrates placement of the microphone 6 (e.g., a signal analyzer) shown in FIG. 1 in one example, where each microphone 6 is disposed within the area defined by each workstation cubicle. In the example shown in FIG. 9, microphone 6 is disposed at a head-worn device (e.g., a telecommunications headset) which may be worn by an employee sitting within the cubicle.

Referring again to FIG. 1, in one example operation, sound 4 corresponding to the test signal is output from a speaker 2 and detected by a microphone 6. The detected test signal is processed to determine the speech transmission quality of the open space between speaker 2 and microphone 6. In the example shown in FIG. 1, a conversation participant 12 is in conversation with a conversation participant 14 in the vicinity of person 10 in the open space. Open space noise 20 includes components of speech 16 from participant 12 and speech 18 from conversation participant 14. If the speech transmission quality of the open space is high, then the intelligibility of speech 16 and speech 18 heard by person 10 will be undesirably high. In contrast, if the speech transmission quality of the open space is low, then the intelligibility of speech 16 and speech 18 heard by person 10 will be desirably low.

Figure 2:
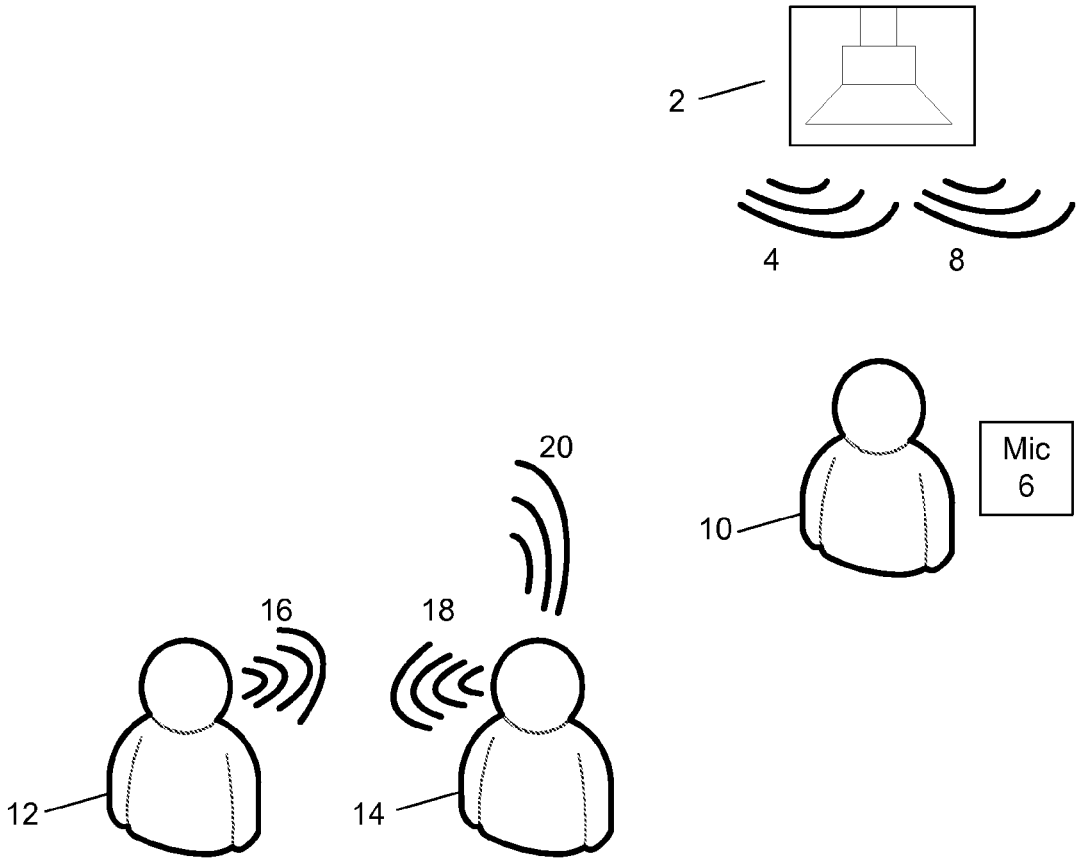
FIG. 2 illustrates a system and method for masking open space noise in one example.

FIG. 2 illustrates a system and method for masking open space noise in one example. In the system illustrated in FIG. 2, a sound 8 is output from speaker 2 corresponding to a noise masking signal configured to mask open space noise. In one example, the noise masking signal configured to mask open space noise output from speaker 2 is a random noise such as pink noise. Sound 8 operates to mask open space noise 20 heard by person 10. Speaker 2 and microphone 6 are as described above in reference to FIG. 1.

In one example operation, sound 8 is output together with sound 4, where sound 4 corresponds to the test signal operable to measure a speech transmission quality of the open space as described in reference to FIG. 1. Sound 8 and sound 4 are detected at a microphone 6. Sound 4 is processed to determine the speech transmission quality of the transmission channel (e.g., the open space air). Responsive to the determined speech transmission quality, the output level of sound 8 is adjusted. For example, the noise masking signal is configured to reduce the speech transmission quality of the transmission channel.

In one example, the test signal output as sound 4 is optimized so that it is partially masked or completely masked (i.e., it's audibility to persons in the open space is reduced) by sound 8. For example, the higher frequency components of the test signal are matched with the higher frequency components of the noise masking signal to blend the two signals. In one example, a method for masking open space noise (e.g., noise 20) includes outputting a masking sound (e.g., sound 8, such as a pink noise) to mask an open space noise (e.g., noise 20) in an open space, and masking an audibility of a test signal sound (e.g., sound 4) utilizing the masking sound (e.g., sound 8). The masking noise (sound 8) may be a random noise and the test signal (sound 4) may be tones. After a defined averaging time the test signal to masking signal noise ratio improves and is ready for speech transmission quality analysis.

In this manner, the noise masking signal operates both to mask sound 4 corresponding to the test signal and mask open space noise 20, providing increased listener comfort. This is particularly advantageous where persons prefer not to hear the test signal or hear the test signal at a reduced level, as some persons may find the test signal by itself discomforting and disruptive. This methodology advantageously allows the noise masking system to utilize the test signal more frequently to dynamically and automatically update the output level and/or the source or spectrum of the noise masking signal to match current open space noise conditions.

In one example, the speech transmission quality determined is an intelligibility index. In one example, the intelligibility index is a Speech Transmission Index (STI). In one example, the output level of the noise masking signal is adjusted until a target Speech Transmission Index is achieved. The masking levels are advantageously dynamically adjusted in response to intelligibility measurements. Intelligibility target levels are established and programmed into the masking system, such that the masking sound level and/or spectrum are adjusted in order to obtain those target levels. Masking levels may be adjusted on a speaker-by-speaker basis in order to address location-specific intelligibility issues.

Figure 3:
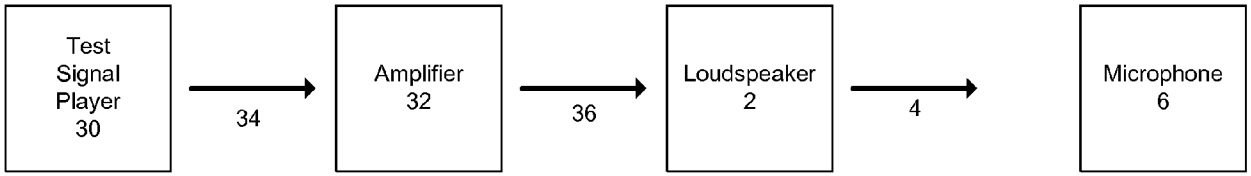
FIG. 3 illustrates a system for outputting a test signal from the speaker shown in FIG. 1 in one example.

FIG. 3 illustrates a system for outputting a test signal from the speaker shown in FIG. 1 in one example. A test signal player 30 outputs an audio signal 34 of a test signal operable to measure a speech transmission quality of an open space air transmission channel. Audio signal 34 is received by an amplifier 32, which outputs an amplified audio signal 36. Amplified audio signal 36 is received by speaker 2 (e.g., a loudspeaker), which outputs the sound 4 of the test signal.

In one example, test signal player 30 is an application program at a computing device. For example, the test signal player 30 may be part of a Speech Transmission Index (STI) measurement application program on a personal computer. Sound 4 is detected at microphone 6, where it is processed to determine the speech transmission quality of the open space air. For example, the sound 4 detected at microphone 6 is processed by the Speech Transmission Index (STI) measurement application program on the personal computer. In one embodiment, an application program such as iSTI by Embedded Acoustics Co. is utilized.

Figure 4:
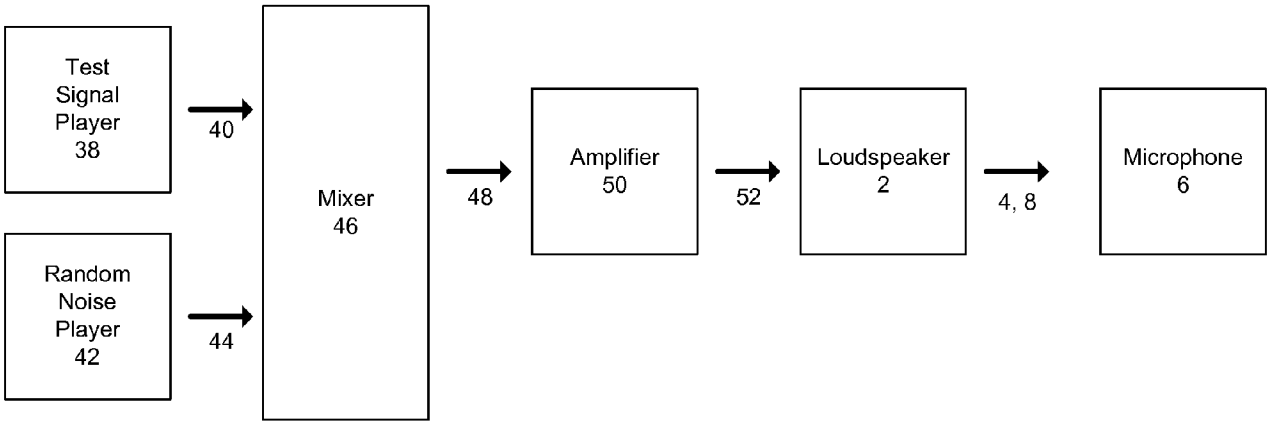
FIG. 4 illustrates a system for outputting a test signal and a noise masking signal from the speaker shown in FIG. 2 in one example.

FIG. 4 illustrates a system for outputting a test signal and a noise masking signal from the speaker shown in FIG. 2 in one example. A test signal player 38 outputs an audio signal 40 of a test signal operable to measure a speech transmission quality of an open space air transmission channel. A random noise player 42 outputs an audio signal 44 of a sound of random noise (e.g., pink noise). In one example, test signal player 38 and random noise player 42 are application programs at a computing device. Although shown as separate applications, they may be integrated into a single application, such as an open space noise masking application program having an integrated STI measurement application program. Audio signal 40 and audio signal 44 are received at mixer 46, which outputs a mixed audio signal 48 containing both audio signal 40 and audio signal 44.

Mixed audio signal 48 is received at amplifier 50, which outputs an amplified mixed audio signal 52. Amplified mixed audio signal 52 is received by speaker 2, which outputs sound 4 of the test signal and sound 8 of random noise. Sound 4 and sound 8 are detected at microphone 6. The output of microphone 6 is processed to isolate sound 4, and sound 4 is processed to determine the speech transmission quality of the open space air. For example, sound 4 detected at microphone 6 is processed by the open space noise masking application program on the personal computer, which responsively adjusts the output level of audio signal 44 based on the determined speech transmission quality.

Figure 5:
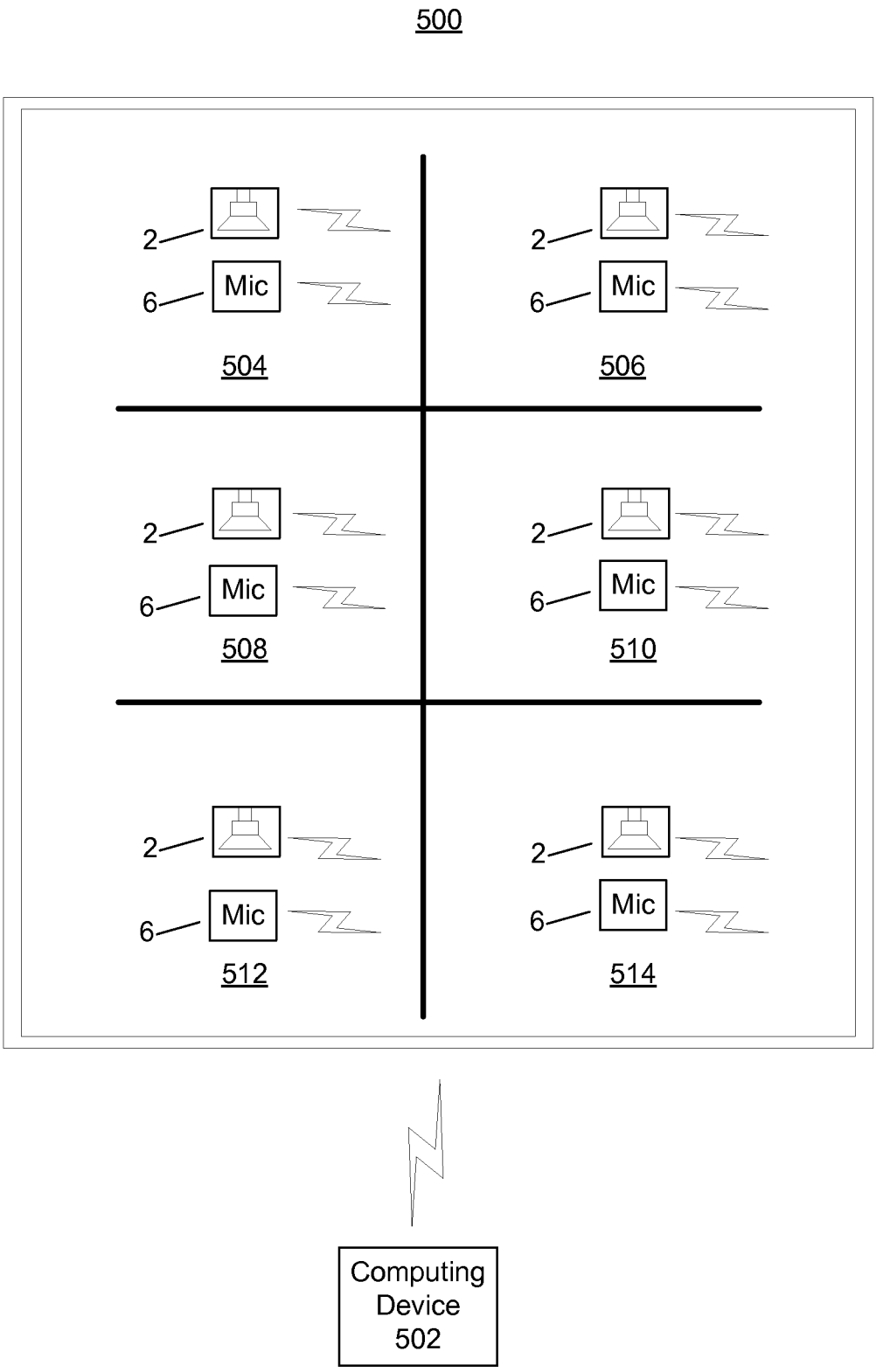
FIG. 5 illustrates placement of the speaker and the microphone shown in FIG. 1 or FIG. 2 in an open space in one example.

FIG. 5 illustrates placement of a plurality of speakers 2 and microphones 6 shown in FIG. 1 or FIG. 2 in an open space 500 in one example. For example, open space 500 may be a large room of an office building in which employee workstations 504, 506, 508, 510, 512, 514, etc., such as cubicles are placed.

In the system shown in FIG. 5, a first speaker 2 is disposed at a first workstation 504 furniture and a first microphone 6 is disposed in the first workstation 504 area. A second speaker 2 is disposed at a second workstation 506 furniture and a second microphone 6 disposed in the second workstation 506 area, and so forth. In one example, the speakers 2 may be advantageously disposed in cubicle wall panels so that they are unobtrusive. The speakers may be planar (i.e., flat panel) speakers in this example to output a highly diffuse noise masking sound. Microphones 6 may be also be disposed in the cubicle wall panels, or located on head-worn devices such as telecommunications headsets within the area of each workstation. In further examples, microphones 6 and speakers 2 may also be located on personal computers, smartphones, or tablet computers located within the area of each workstation.

Figure 10:
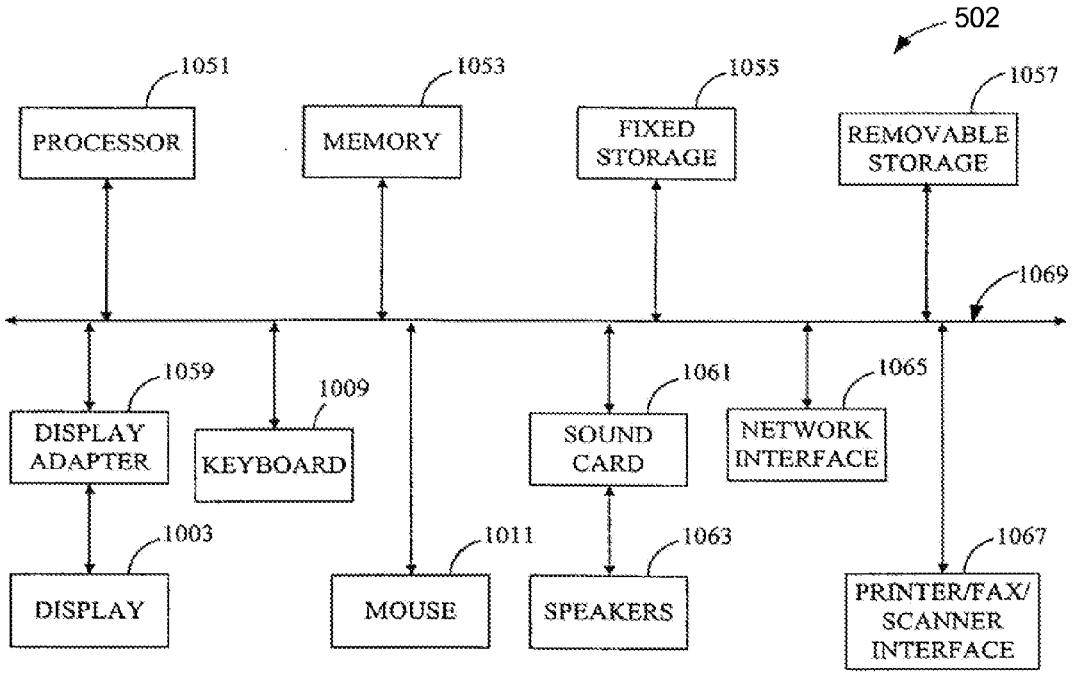
FIG. 10 illustrates a system block diagram of a computing device suitable for executing software application programs that implement the methods and processes described herein in one example.

The system includes a computing device 502 including a processor and a memory storing application program comprising instructions executable by the processor to perform operations as described herein to output and process test signals and output noise masking signals. FIG. 10 illustrates a system block diagram of a computing device 502 in one example. Computing device 502 is capable of electronic communications with each speaker 2 and microphone 6 via either a wired or wireless communications link. For example, computing device 502, speakers 2, and microphones 6 are connected via one or more communications networks such as a local area network (LAN) or an Internet Protocol network. In a further example, a separate computing device 502 may be provided at each workstation for each speaker 2 and microphone 6 pair.

In one example, the operations include outputting a test signal from a first speaker at a first workstation 504 or a second speaker at a second workstation 506. The test signal is operable to measure a speech transmission quality. In one example, the test signal comprises a modulated multi-tone signal having a frequency signature similar to human speech. The operations further include detecting the test signal at the first microphone at the first workstation 504 and adjusting an output level of a first noise masking signal from the first speaker at the first workstation 504 responsive to the detected test signal. In one application, the detected test signal is processed to calculate an intelligibility index. The output level of the first noise masking signal is then adjusted to achieve a target intelligibility index. For example, an iterative test and adjust process is utilized to achieve the target index. In one example, the test signal is output simultaneously with the first noise masking signal and configured to be masked by the first noise masking signal.

In one example, the operations further include outputting a second test signal from the first speaker at the first workstation 504 or the second speaker at the second workstation 506. The second test signal is operable to measure a speech transmission quality. The operations further include detecting the second test signal at the second microphone at the second workstation 506 and adjusting an output level of a second noise masking signal from the second speaker responsive to the detected second test signal.

Utilizing the system shown in FIG. 5, the speech transmission quality of the open space air at each workstation 504, 506, etc. can be determined to account for differences in the speech transmission quality at particular areas within open space 500. For example, utilizing the determined speech transmission quality at workstation 504 and the determined speech transmission quality at workstation 506, the output level of the first noise masking signal from the speaker at workstation 504 may be different from the output level of the second noise masking signal from the speaker at workstation 506. In one example, each speaker has a unique Internet Protocol address for individual control.

Figure 6:
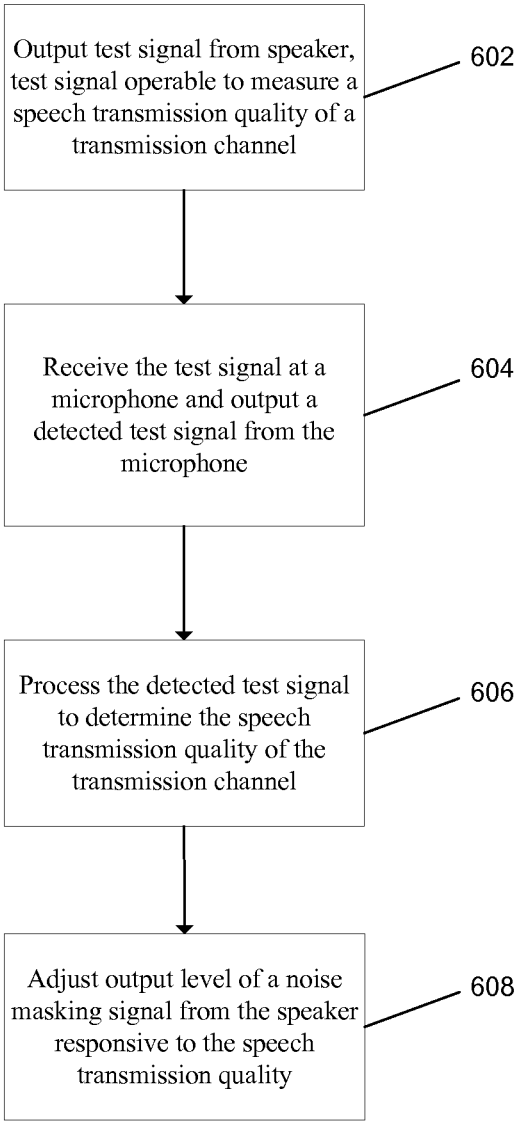
FIG. 6 is a flow diagram illustrating masking open space noise in one example.

FIG. 6 is a flow diagram illustrating masking open space noise in one example. At block 602, a test signal is output from a speaker, where the test signal is operable to measure a speech transmission quality of a transmission channel such as air. In one example, the test signal comprises a modulated multi-tone signal having a frequency signature similar to human speech. In one example, the speech transmission quality comprises an intelligibility index. In one example, the speaker is disposed at a workstation furniture.

At block 604, the test signal is received at a microphone. In one example, the microphone is disposed on a head-worn device. The detected test signal is output from the microphone. At block 606, the detected test signal is processed to determine the speech transmission quality of the transmission channel.

At block 608, an output level of a noise masking signal output from the speaker is adjusted responsive to the determined speech transmission quality. In one example, the noise masking signal is configured to reduce the speech transmission quality of the transmission channel. In one example, the noise masking signal is a pink noise. In one example, the output level of the noise masking signal is adjusted immediately responsive to the determined speech transmission quality. In a further example, the output level of the noise masking signal is adjusted based on several measurements of the speech transmission quality taken over a period of time. In one example, the output level is adjusted gradually over a period of time so as to minimize detectability or annoyance to listeners.

Figure 7:
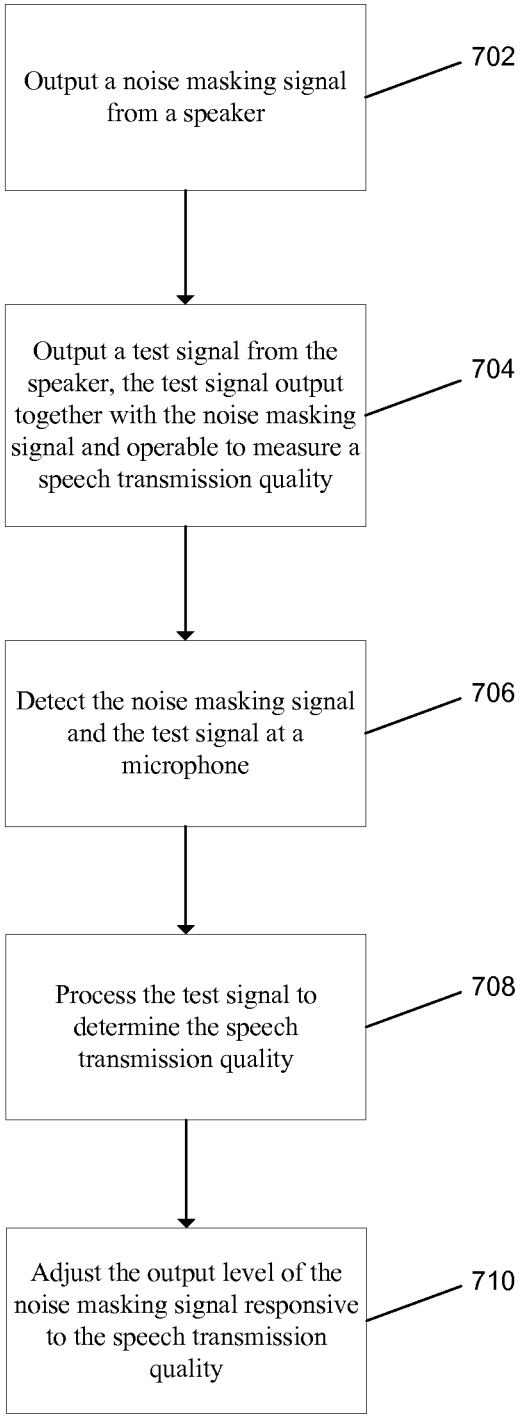
FIG. 7 is a flow diagram illustrating masking open space noise in one example.

FIG. 7 is a flow diagram illustrating masking open space noise in one example. At block 702, a noise masking signal is output from a speaker. In one example, the speaker is disposed at a workstation furniture. In one example, the noise masking signal is configured to reduce the speech transmission quality of a transmission channel. For example, the noise masking signal is a pink noise.

At block 704, a test signal is output from the speaker, where the test signal is output together with the noise masking signal and is operable to measure a speech transmission quality of the transmission channel. In one example, the test signal is a modulated multi-tone signal having a frequency signature similar to human speech. In one example, the test signal is optimized to be masked by the noise masking signal when output from the speaker.

At block 706, the noise masking signal and the test signal are detected at a microphone. In one example, the microphone is located within a workstation cubicle. For example, the microphone is disposed on a head-worn device such as a telecommunications headset worn by an employee sitting within the workstation cubicle.

At block 708, the test signal is processed to determine the speech transmission quality of the transmission channel. At block 710, the output level of the noise masking signal is adjusted responsive to the determined speech transmission quality. In one example, the speech transmission quality is an intelligibility index and the output level of the noise masking signal is adjusted until a target intelligibility index is achieved. In one example, the output level of the noise masking signal is adjusted immediately responsive to the determined speech transmission quality. In a further example, the output level of the noise masking signal is adjusted based on several measurements of the speech transmission quality taken over a period of time. In one example, the output level is adjusted gradually over a period of time so as to minimize detectability or annoyance to listeners.

FIG. 10 illustrates a system block diagram of the computing device 502 suitable for executing software application programs that implement the methods and processes described herein. The architecture and configuration of the computing device 502 shown and described herein are merely illustrative and other computer system architectures and configurations may also be utilized.

The exemplary computing device 502 includes a display 1003, a keyboard 1009, and a mouse 1011, one or more drives to read a computer readable storage medium, a system memory 1053, and a hard drive 1055 which can be utilized to store and/or retrieve software programs incorporating computer codes that implement the methods and processes described herein and/or data for use with the software programs, for example. For example, the computer readable storage medium may be a CD readable by a corresponding CD-ROM or CD-RW drive 1013 or a DVD readable by a corresponding DVD drive. Computer readable medium typically refers to any data storage device that can store data readable by a computer system. Examples of computer readable storage media include magnetic media such as hard disks, floppy disks, and magnetic tape, optical media such as CD-ROM disks, magneto-optical media such as optical disks, and specially configured hardware devices such as application-specific integrated circuits (ASICs), programmable logic devices (PLDs), and ROM and RAM devices.

The computing device 502 includes various subsystems such as a microprocessor 1051 (also referred to as a CPU or central processing unit), system memory 1053, fixed storage 1055 (such as a hard drive), removable storage 1057 (such as a CD-ROM drive), display adapter 1059, sound card 1061, transducers 1063 (such as speakers and microphones), network interface 1065, and/or printer/fax/scanner interface 1067. The computing device 502 also includes a system bus 1069. However, the specific buses shown are merely illustrative of any interconnection scheme serving to link the various subsystems. For example, a local bus can be utilized to connect the central processor to the system memory and display adapter. Methods and processes described herein may be executed solely upon CPU 1051 and/or may be performed across a network such as the Internet, intranet networks, or LANs (local area networks) in conjunction with a remote CPU that shares a portion of the processing.

While the exemplary embodiments of the present invention are described and illustrated herein, it will be appreciated that they are merely illustrative and that modifications can be made to these embodiments without departing from the spirit and scope of the invention. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. A method comprising:

outputting a test signal together with a noise masking signal from a speaker, the noise masking signal configured to mask audibility of the test signal and the test signal operable to measure a speech transmission quality of a transmission channel;

receiving the test signal and the noise masking signal at a microphone and outputting a detected test signal;

processing the detected test signal to determine the speech transmission quality of the transmission channel; and adjusting an output level of the noise masking signal from the speaker responsive to the speech transmission quality.

2. The method of claim 1, wherein the test signal comprises a modulated multi-tone signal having a frequency signature similar to human speech.

3. The method of claim 1, wherein the speech transmission quality comprises an intelligibility index.

4. The method of claim 1, wherein the noise masking signal is configured to mask audibility of the test signal and configured to reduce the speech transmission quality of the transmission channel.

5. The method of claim 1, wherein the noise masking signal is a pink noise.

6. The method of claim 1, wherein the speaker is disposed at a workstation furniture.

7. The method of claim 1, wherein the microphone is disposed on a head-worn device.

8. A method comprising:

outputting a noise masking signal configured to mask audibility of a test signal from a speaker;

outputting the test signal from the speaker, the test signal output together with the noise masking signal to mask audibility of the test signal with the noise masking signal, the test signal operable to measure a speech transmission quality of a transmission channel;

detecting the noise masking signal and the test signal at a microphone;

processing the test signal to determine the speech transmission quality of the transmission channel; and adjusting an output level of the noise masking signal responsive to the speech transmission quality.

9. The method of claim 8, wherein the test signal comprises a modulated multi-tone signal having a frequency signature similar to human speech.

10. The method of claim 8, further comprising configuring the test signal to be masked by the noise masking signal when output from the speaker.

11. The method of claim 8, wherein the speech transmission quality comprises an intelligibility index.

12. The method of claim 11, wherein the output level of the noise masking signal is adjusted until a target intelligibility index is achieved.

13. The method of claim 8, wherein the noise masking signal is configured to reduce the speech transmission quality of the transmission channel.

14. The method of claim 8, wherein the speaker is disposed at a workstation furniture.

15. The method of claim 8, wherein the microphone is disposed on a head-worn device.

16. A system comprising:

a first workstation;

a first speaker disposed at a first workstation furniture;

a first microphone disposed in a first workstation area;

a second workstation;

a second speaker disposed at a second workstation furniture;

a second microphone disposed in a second workstation area; and a computing device comprising:

a processor; and a memory storing an application program comprising instructions executable by the processor to perform operations comprising:

outputting a test signal and a first noise masking signal from the first speaker or the second speaker, the test signal operable to measure a speech transmission quality, wherein the first noise masking signal is configured to mask audibility of the test signal; and detecting the test signal and the first noise masking signal at the first microphone and adjusting an output level of the first noise masking signal from the first speaker responsive to the detected test signal.

17. The system of claim 16, wherein the operations further comprise:

outputting a second test signal from the first speaker or the second speaker, the second test signal operable to measure a speech transmission quality; and detecting the second test signal at the second microphone and adjusting an output level of a second noise masking signal from the second speaker responsive to the detected second test signal.

18. The system of claim 17, wherein the output level of the first noise masking signal is different from the output level of the second noise masking signal.

19. The system of claim 16, wherein the first workstation furniture comprises a cubicle wall panel and the second workstation furniture comprises a cubicle wall panel.

20. The system of claim 16, wherein the first microphone is disposed at a first head-worn device and the second microphone is disposed at a second head-worn device.

21. The system of claim 16, wherein the detected test signal is processed to calculate an intelligibility index.

22. The system of claim 21, wherein the output level of the first noise masking signal is adjusted to achieve a target first intelligibility index.

23. The system of claim 16, wherein the first noise masking signal is output together with the test signal.

24. The system of claim 23, wherein the test signal is configured to be masked by the first noise masking signal.

* * * * *